United States Patent [19]

Szentlaszloi et al.

[11] Patent Number: 4,950,390

[45] Date of Patent: Aug. 21, 1990

[54] APPARATUS AND METHOD FOR FROTH FLOTATION

[75] Inventors: Alex Szentlaszloi, Hockessin, Del.; Earl T. Robinson, Aston, Pa.

[73] Assignee: BP America Inc., Cleveland, Ohio

[21] Appl. No.: 314,458

[22] Filed: Feb. 23, 1989

[51] Int. Cl.[5] ..... B03D 1/14

[52] U.S. Cl. ..... 209/164; 209/168

[58] Field of Search ..... 209/164, 168, 169, 170; 210/221.1, 221.2, 219

[56] References Cited

U.S. PATENT DOCUMENTS

| | | | |
|---|---|---|---|
| 1,881,412 | 10/1932 | MacCamy | 209/169 |
| 1,984,366 | 12/1934 | Fahranwald | 209/169 |
| 2,350,943 | 6/1944 | Thompson | 209/169 |
| 3,037,626 | 6/1962 | Takahashi | 209/169 |
| 4,304,573 | 12/1981 | Burgess et al. | 209/168 |
| 4,347,126 | 8/1982 | McGarry | 209/168 |
| 4,347,127 | 8/1982 | Duttera | 209/168 |
| 4,412,843 | 11/1983 | Burgess et al. | 209/168 |
| 4,514,291 | 4/1985 | Duttera | 209/170 |
| 4,650,567 | 3/1987 | McGarry et al. | 209/168 |

*Primary Examiner*—David L. Lacey
*Assistant Examiner*—Thomas M. Lithgow
*Attorney, Agent, or Firm*—Michael F. Esposito; David J. Untener; Larry W. Evans

[57] ABSTRACT

An improved apparatus and method for froth flotation separation of the components of a slurry is provided wherein improved recycling capability is provided by utilization of a partition in the flotation tank in which the froth flotation is performed.

9 Claims, 2 Drawing Sheets

APPARATUS AND METHOD FOR FROTH FLOTATION

BACKGROUND OF THE INVENTION

This invention relates to an apparatus and method for flotation separation and more particularly to an apparatus and method for froth flotation separation and beneficiation of mineral ores and carbonaceous matter.

Froth flotation operates to separate finely ground valuable minerals from their associated gangue. In general, the frothing process is carried out by introducing air into a pulp or slurry of finely divided mineral ore or other matter desired to be floated in water containing a frothing or foaming agent whereby a froth is formed. The particulate mineral matter with a specific affinity for air bubbles rises to the surface in the froth and is thus separated from the gangue wetted by the water.

Conventional prior art processes for froth flotation separation of a slurry or pulp of particulate matter typically include those processes based on constructions wherein air is introduced into the liquid slurry or pulp of the particulate matter as, e.g., through a porous cell bottom or a hollow impeller shaft, thereby producing a surface froth.

Improved methods and apparatus for carrying out froth flotation separation of coal and other minerals are disclosed in U.S. Pat. No. 4,347,126 and U.S. Pat. No. 4,347,127. These patents disclose a flotation apparatus wherein a primary feed spray nozzle is positioned above the flotation tank for spraying input slurry, such as particulate coal or mineral ore, into the tank and a recycle spray nozzle is positioned above the tank for respraying particulate matter collected in a collection trough positioned in the tank for collecting sinking material. In this apparatus, the particles collected in the trough are recycled and a portion of the recycled particulates float as a froth on the water surface an additional time and are recovered. In the apparatus of U.S. Pat. No. 4,347,127, the recycled spray nozzle is positioned in proximity to the primary feed spray nozzle and a vertical baffle plate is positioned in the tank to provide separation for materials sinking from the sprays of the respective nozzles.

While the apparatus of U.S. Pat. No. 4,347,127 provides for good yields of beneficiated product, improvements in the apparatus are desired For example, the collection means for collecting sinking material, i.e., the collection trough, in said U.S. Pat. No. 4,347,127 has not proven to be an efficient means for collecting sinking materials for the purpose of recycling the same. Accordingly, much of the sinking material, which could be recycled to provide improved yields of product, is lost.

SUMMARY OF THE INVENTION

Accordingly, it is one object of the present invention to provide an improved apparatus and method for froth flotation separation of particulate matter such as minerals and carbonaceous matter.

Another object of this invention is to provide an apparatus and method for froth flotation separation of the components of a slurry, said apparatus and method having improved recycling capability, thereby providing for improved yields of product.

These and other objects are achieved herein by providing an apparatus for froth flotation separation of the components of a slurry having particulate matter therein which is to be separated, said apparatus comprising:

(a) a flotation tank including means for withdrawing a floating fraction and means for withdrawing a tailings fraction;

(b) means for feeding slurry into said flotation tank, said means comprising at least one primary spray nozzle positioned above said flotation tank;

(c) at least one recycle spray nozzle positioned above said flotation tank for spraying collected sinking materials into said flotation tank; and (d) a partition wall extending vertically from the bottom of said flotation tank to a point below the liquid level to be contained in said tank and extending horizontally from one side to the opposite side of said tank, said partition wall positioned between said primary spray nozzle and said recycle spray nozzle to provide separation for materials sinking from the sprays of the primary and recycle spray nozzles.

Other objects of the present invention are accomplished herein by providing a method for froth flotation separation of the components of a slurry having particulate matter therein to be separated, said method comprising the steps of:

(a) spraying an input slurry or pulp of particulate matter into a liquid contained in a flotation tank through a primary spray nozzle to create a froth on the surface of said liquid contained in said flotation tank, said froth having a substantial quantity of particulate matter floating therein, while a minor quantity of particulate matter sinks in the liquid;

(b) collecting and withdrawing the sinking particulate matter from said flotation tank and recycling the withdrawn sinking particulate matter to a recycle spray nozzle;

(c) respraying the recycled sinking particulate matter into the liquid contained in said flotation tank to create further froth on the surface of the liquid; and (d) withdrawing the froth formed in steps (a) and (c).

DETAILED DESCRIPTION OF THE INVENTION

The apparatus of the present invention is suitable for the separation of a wide variety of solid-fluid streams by the creation of a solids containing froth phase and is thereby suitable for the separation and beneficiation of many types of solid particulate matter. Thus, the present invention is readily applicable to froth flotation separation and beneficiation of mineral ores, carbonaceous matter, such as coal, mineral dressings, fines, mine tailings, oil shale, waste particulates and the like.

Figure 1:
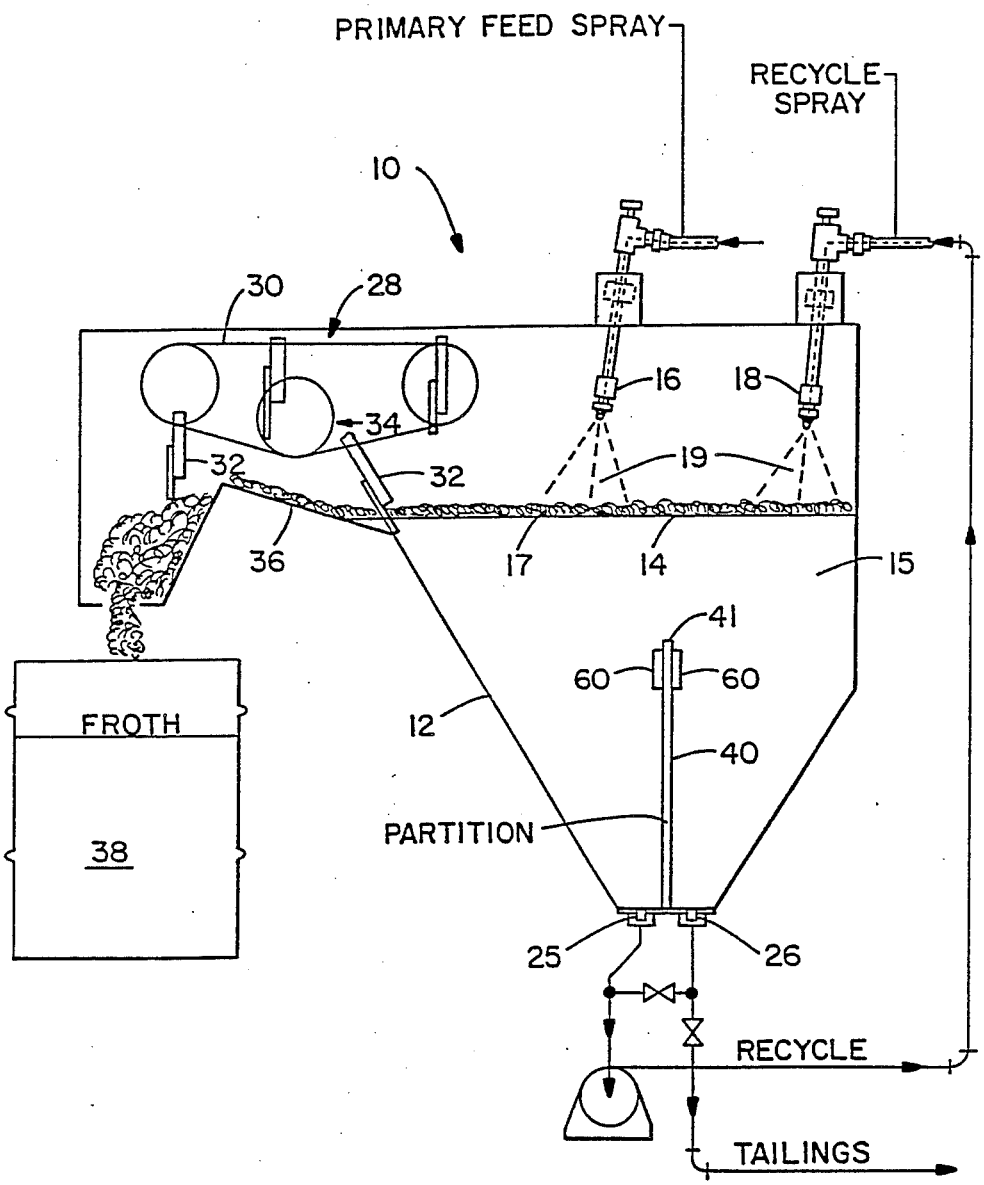
FIG. 1 is an elevational, cross-sectional side view of the improved flotation apparatus of the present invention illustrating, inter alia, the position of the partition wall in the flotation tank; and, FIG. 2 is a top view of an improved flotation apparatus of the present invention also illustrating, inter alia, the position of the partition wall in the tank.

Referring to the drawing in greater detail, FIG. 1 illustrates an embodiment 10 of the present invention having a flotation tank 12 filled with water to level 14. In operation, a slurry or pulp of finely ground mineral ore or coal particles, associated impurities and if desired additional additives, such as frothing agents, collecting agents, chemical monomer, chemical catalysts and/or fluid hydrocarbons such as fuel oil, such as any or all of the additives disclosed in U.S. Pat. Nos. 4,304,573 and 4,412,843 (incorporated herein by reference) is sprayed through at least one primary spray nozzle 16 positioned at a distance above the water level in tank 12. In alternative embodiments, two or more primary nozzles can be used to spray slurry or pulp and/or any other desired ingredients into the tank 12.

The stream of treated particulate matter is pumped under pressure through a manifold to the primary spray nozzle 16 wherein the resultant shearing forces spray the slurry or pulp as fine droplets such that they are forcefully jetted into the mass of a continuous water bath 15 in tank 12. High shearing forces are created in nozzle 16, and the dispersed particles forcefully enter the surface of the water and break up thereby water-wetting and releasing impurities from the interstices so that the exposed surfaces of the impurities are introduced into the water and separated from the floating mineral or coal particles. The surfaces of the finely divided coal or mineral particles now contain air sorbed on the atomized particles, much of which is entrapped by spraying the slurry or pulp through an aeration zone 19 such that air is sorbed in the sprayed slurry or pulp. The combined effects on the treated coal or mineral particles cause the particles to decrease in apparent density and to float on the surface of the water bath. The hydrophilic impurities remain in the bulk water phase, and settle downwardly in tank 12.

Figure 2:
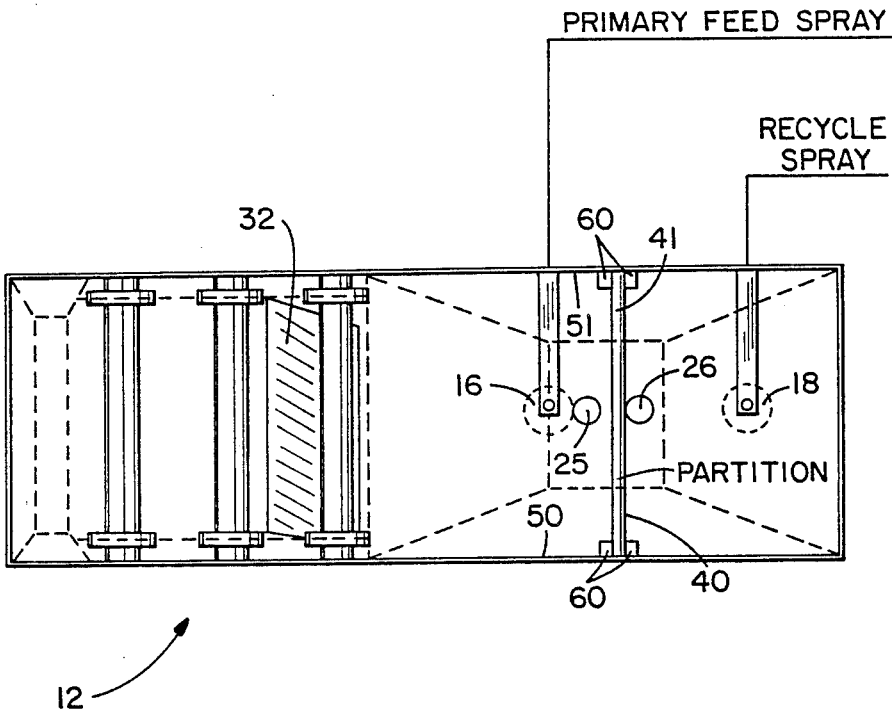

The present invention provides an improved and more efficient recycling operation. In the recycling operation, particles which do not float after being sprayed through primary spray nozzle 16 are withdrawn from recycle stream 25 and recycled to a recycle spray nozzle 18 to provide the particles a second opportunity for recovery. At least one recycle spray nozzle 18 is provided above the tank for respraying collected materials into the surface of the water bath such that the collected particles are recycled and a portion of the recycled particles floats as a froth on the water surface an additional time and is recovered. The recycled spray nozzle(s) 18 is positioned in proximity to the primary spray nozzle(s) 16. In alternative embodiments further stages of recycling may be provided by adding additional recycle nozzles to the tank. In accordance with the improvement of the present invention, a partition wall 40 is positioned in tank 12 between primary feed spray 16 and recycle spray 18. The partition wall 40 extends vertically from the bottom of tank 12 to a point below the water level 14 in the tank. The precise point at which the top edge 41 of the partition wall 40 is below the water level 14 may vary depending upon slurry and solids properties, primary and recycle flow pressure and nozzle type, height and angle Generally, the top edge 41 of the partition wall 40 is positioned at a point below the water surface so as to optimize the segregation of the primary tailings from the recycle tailings, allowing the primary tailings to enter the recycle pump and be sprayed through the recycle nozzle and directing the recycle tailings to waste. As better illustrated in FIG. 2, the partition wall 40 extends horizontally from one side of the tank 12 to the opposite side of the tank 12 (i.e., extends the full width of tank 12), abutting the respective inside sidewalls 50 and 51, of the tank 12. In the embodiment shown in FIGS. 1 and 2, use of sleeve components 60, which are fixed to the respective sidewalls, secure partition wall 40 in the tank 12 and further allow, if desired, for the ready removal of the partition from the tank. Other means for holding partition 40 in place, such as welding or bolting of the bottom and sides of the partition to the bottom and respective sides of the tank 12 are obviously well within the scope of the present invention. Thus, the partition wall 40 divides the underflow in tank 12 into a recycle and tailings discharge as illustrated in FIGS. 1 and 2. All of the underflow, as contained by the partition 40 in the tank, may be recycled through the recycle spray nozzles by proper setting of the valves. However, lower (or zero) recycling rates may also be obtained by adjusting the valves so that a portion (or all) of the flow will be diverted to the tailings.

The arrangement of the present invention results in an efficient operation, providing more effective flotation of mineral ore or carbonaceous matter and higher product recoveries by providing that particles which do not initially float have a high probability of being resprayed onto the water surface to promote secondary recovery of the product from Waste materials. After the recycling operation, the materials which sink from the recycle spray tend to settle downwardly in tank 12 under the influence of gravity, and are withdrawn in tailings stream 26 from the base of the tank.

The particles in the floating froth 17 created by nozzles 16 and 18 are removed from the water surface by a skimming arrangement 28 in which an endless conveyor belt 30 carries a plurality of spaced skimmer plates 32 depending therefrom. The skimmer plates are pivotally attached to the conveyor belt to pivot in two directions relative to the belt, and the bottom run of the belt is positioned above and parallel to the water surface in the tank. The plates 32 skim the resultant froth on the water surface in a first direction 34 toward a surface 36, preferably upwardly inclined, extending from the water surface to a collection tank 38 arranged at one side of the flotation tank, such that the skimmer plates 32 skim the froth from the water surface up the surface 36 and into the froth collection tank 38.

Spray nozzles 16 or 18 may be hollow jet nozzles as are commercially available from Spraying Systems Co., Wheaton, Ill. Preferred spray nozzles, however, are the spiral, open flow nozzles disclosed in U.S. Pat. No. 4,514,291 and U.S. Pat. No. 4,650,567, both of which are incorporated by reference herein. Such nozzles are commercially available from Bete Fog Nozzle, Inc., Greenfield, Mass. Of course it is contemplated herein that other types of nozzles, which function to provide the desired results as hereinbefore described, can also be used. The nozzles are preferably constructed of stainless steel, ceramic or other suitable hard metal to avoid erosion by the various particles in the slurry or pulp being pumped tnerethrough. Thus, the spray nozzles used in accordance with the present invention are adapted to spray slurry or pulp in a diverging spray pattern and in a manner wherein the slurry or pulp is dispersed through an aeration zone of increasing cross sectional area into the liquid surface in the flotation tank. The nozzles are preferably supplied with slurry or pulp in the supply manifolds at a pressure in the range of 5 to 40 psi, and more preferably in a pressure range of 7 to 20 psi.

Each nozzle may be tilted at an angle with respect to a vertical, as shown in FIG. 1 such that it functions to direct the flow of froth in that direction towards the skimmer arrangement 28. However, the angle does not appear to be critical, and a vertical positioning may be preferred to create a condition best conducive to agitation and froth generation at the water surface. It appears to be important that the agitation created by the nozzle sprays define a zone of turbulence extending a limited distance beneath the water surface level. Too much turbulence may actually reduce the amount of frothing produced at the water surface. The depth of the turbulence zone may be adjusted by varying the supply pressure of the slurry or pulp in the supply manifolds and also the distance of the nozzles above the water surface.

While several embodiments and variations of a method and apparatus for froth flotation separation of the components of a slurry or pulp have been described in detail herein, it should be apparent that the teachings and disclosure herein will suggest many other embodiments and variations to those skilled in this art.

We claim:

1. Apparatus for froth flotation separation of the components of a slurry having particulate matter therein which is to be separated, said apparatus comprising:

(a) a flotation tank for containing a quantity of liquid and including means for withdrawing a floating froth fraction and means for withdrawing a final tailings fraction;

(b) means for feeding slurry into said flotation tank, said means comprising at least one primary spray nozzle positioned above said flotation tank;

(c) at least one recycle spray nozzle positioned above said flotation tank; and (d) a partition wall extending vertically from bottom of said flotation tank to a point below the level of the liquid to be contained in said tank and horizontally from one side to the opposite side of said tank thereby dividing the tank into a first portion above which the primary spray nozzle is located and a second portion above which the recycle spray nozzle is located and in which said final tailings withdrawal means is located, said partition wall being of sufficient height to segregate a recycle tailings fraction which is sinking in the first portion from said final tailings fraction which is sinking in said second portion; and

2. The apparatus of claim 1 wherein said primary spray nozzle is a spiral, open-flow spray nozzle.

3. The apparatus of claim 1 wherein said recycle spray nozzle is a spiral, open-flow spray nozzle.

4. The apparatus of claim 1 wherein said means for withdrawing said floating fraction includes a skimmer means adapted to operate along the top of said tank for skimming froth from a liquid surface in the tank.

5. A method for froth flotation separation of the components of a slurry having particulate matter therein which is to be separated, said method comprising the steps of:

(a) spraying an input slurry or pulp of particulate matter into a liquid contained in a flotation tank through a primary spray nozzle to create a froth on the surface of said liquid contained in said flotation tank, said froth having a substantial quantity of particulate matter floating therein, while a minor quantity of recycle particulate matter sinks in the liquid, in a first portion of the tank;

providing a partition wall extending vertically from the bottom of the flotation tank to a point below the surface of the liquid contained in the tank and horizontally from one side to the opposite side of the tank thereby dividing the tank into the first portion above which the primary nozzle is located and a second portion above which a recycle spray nozzle is located; (c) collecting the recycle particulate matter sinking in said first portion and respraying the recycled particulate matter through said recycle spray nozzle into the liquid contained in said flotation tank to create further froth on the surface of the liquid and a minor quantity of tailings particulate matter which sinks in said second portion, said partition wall being of sufficient height to segregate said recycle particulate matter sinking in said first portion from said tailings particulate matter sinking in the second portion; and (d) withdrawing the froth formed in steps (a) and (c) withdrawing said tailings particulate matter from said second portion.

6. The method of claim 5 wherein said primary spray nozzle is a spiral, open-flow spray nozzle.

7. The method of claim 5 wherein said recycle spray nozzle is a spiral, open-flow spray nozzle.

8. The method of claim 5 wherein said input slurry or pulp of particulate matter is mineral ore.

9. The method of claim 5 wherein said input slurry or pulp of particulate matter is coal.

* * * * *